US008939220B2

(12) United States Patent
Harris

(10) Patent No.: US 8,939,220 B2
(45) Date of Patent: Jan. 27, 2015

(54) EXPANDABLE SLIP RING FOR USE WITH LINER HANGERS AND LINER TOP PACKERS

(75) Inventor: Michael J. Harris, Houston, TX (US)

(73) Assignee: Smith International, Inc., Houston, TX (US)

( * ) Notice: Subject to any disclaimer, the term of this patent is extended or adjusted under 35 U.S.C. 154(b) by 594 days.

(21) Appl. No.: 12/986,737

(22) Filed: Jan. 7, 2011

(65) Prior Publication Data

US 2011/0247832 A1 Oct. 13, 2011

Related U.S. Application Data

(60) Provisional application No. 61/292,938, filed on Jan. 7, 2010.

(51) Int. Cl.

| | |
|---|---|
| ***E21B 23/01*** | (2006.01) |
| ***E21B 23/06*** | (2006.01) |
| ***E21B 33/04*** | (2006.01) |
| ***E21B 33/10*** | (2006.01) |
| ***E21B 33/1295*** | (2006.01) |

(52) U.S. Cl.
CPC ..... *E21B 33/04* (2013.01); *E21B 33/10* (2013.01); *E21B 33/1295* (2013.01)
USPC ..... 166/382; 166/138; 166/216; 166/217

(58) Field of Classification Search
USPC ..... 166/382, 118, 138, 208, 216, 217
See application file for complete search history.

(56) References Cited

U.S. PATENT DOCUMENTS

| | | | | |
|---|---|---|---|---|
| 2,715,441 | A * | 8/1955 | Bouvier | 166/127 |
| 3,285,343 | A * | 11/1966 | Urbanosky | 166/134 |
| 3,298,440 | A * | 1/1967 | Current | 277/340 |
| 3,303,885 | A * | 2/1967 | Kisling, III | 166/134 |
| 3,506,067 | A * | 4/1970 | Lebourg | 166/134 |
| 3,608,632 | A * | 9/1971 | Solum | 166/124 |
| 4,397,351 | A * | 8/1983 | Harris | 166/134 |
| 4,440,223 | A * | 4/1984 | Akkerman | 166/217 |
| 5,240,076 | A * | 8/1993 | Cromar et al. | 166/382 |
| 5,819,846 | A * | 10/1998 | Bolt, Jr. | 166/123 |
| 6,164,377 | A * | 12/2000 | Roberts | 166/118 |
| 6,793,022 | B2 * | 9/2004 | Vick et al. | 166/382 |
| 7,225,867 | B2 * | 6/2007 | Mackenzie et al. | 166/250.08 |
| 7,373,988 | B2 | 5/2008 | Campbell et al. | |
| 7,607,476 | B2 * | 10/2009 | Tom et al. | 166/207 |
| 7,665,516 | B2 * | 2/2010 | Roberts et al. | 166/118 |
| 7,762,323 | B2 * | 7/2010 | Frazier | 166/126 |
| 8,459,347 | B2 * | 6/2013 | Stout | 166/138 |
| 8,469,088 | B2 * | 6/2013 | Shkurti et al. | 166/192 |

(Continued)

*Primary Examiner* — Jennifer H Gay

(57) ABSTRACT

A liner hanger includes a mandrel and a slip assembly disposed around the mandrel, wherein the slip assembly includes an expandable non-frangible slip ring and a plurality of gripping members. A liner top packer includes a mandrel, a slip assembly disposed around the mandrel, and a sealing element disposed around the mandrel, wherein the slip assembly includes an expandable non-frangible slip ring and a plurality of gripping members disposed circumferentially around the expandable non-frangible slip ring. A method for setting a tool in a wellbore includes running the tool having a slip assembly disposed around a mandrel of the tool into the wellbore, positioning the tool at a predetermined wellbore location, actuating the tool to impart a force on the slip assembly, and expanding the expandable non-frangible slip ring from a first diameter to a second diameter to displace the gripping members radially outward into engagement with a surrounding surface.

18 Claims, 6 Drawing Sheets

(56) References Cited

U.S. PATENT DOCUMENTS

2005/0230108 A1* 10/2005 Mackenzie et al. ..... 166/250.01
2008/0047704 A1* 2/2008 Tom et al. ..... 166/118
2008/0073074 A1* 3/2008 Frazier ..... 166/138
2008/0264627 A1* 10/2008 Roberts et al. ..... 166/118
2010/0263857 A1* 10/2010 Frazier ..... 166/127
2011/0247832 A1* 10/2011 Harris ..... 166/382
2012/0261116 A1* 10/2012 Xu ..... 166/208

* cited by examiner

EXPANDABLE SLIP RING FOR USE WITH LINER HANGERS AND LINER TOP PACKERS

CROSS-REFERENCE TO RELATED APPLICATIONS

This application, pursuant to 35 U.S.C. §119(e), claims priority to U.S. Provisional Application Ser. No. 61/292,938, filed Jan. 7, 2010, and which is incorporated herein by reference in its entirety.

BACKGROUND

1. Field of the Disclosure

Embodiments disclosed herein relate generally to an apparatus and method for hanging and supporting downhole devices. Other embodiments relate to supporting a liner hanger, and cementing and packing off a liner within a wellbore. Specific embodiments relate to a slip assembly having an expandable slip ring and gripping members that displace outwardly into engagement with the surface of a surrounding tubular.

2. Background Art

Typically, in the drilling of a well, a borehole is drilled from the earth's surface to a selected depth and a string of casing is suspended and then cemented in place within the borehole. A drill bit is then passed through the initial cased borehole and is used to drill a smaller diameter borehole to an even greater depth. A smaller diameter casing is then suspended and cemented in place within the new borehole. Generally, this is repeated until a plurality of concentric casings are suspended and cemented within the well to a depth which causes the well to extend through one or more hydrocarbon producing formations.

Oftentimes, rather than suspending a concentric casing from the bottom of the borehole to the surface, a liner may be hung either adjacent the lower end of a previously suspended and cemented casing, or from a previously suspended and cemented liner. A liner hanger is used to suspend the liner within the lower end of the previously set casing or liner. A setting tool disposed on the lower end of a work string is releasably connected to the liner hanger that is coupled with the top of the liner. The liner hanger, liner, setting tool, and other components are generally part of a liner hanger assembly.

Another component, such as a liner top packer, may also be part of the liner hanger assembly, which may be used to seal the liner in the event of a poor cement job or to prevent gas flow while the cement sets. Typically, the liner top packer is set down on top of the liner hanger, and the packer is set by the setting tool to seal the annulus between the liner and the previously set casing or liner. Liner top packers run with liner hangers typically include a tubular member with a bore in it that is coupled with the top end of the packer.

This tubular member is commonly referred to as a polished bore receptacle ("PBR") or a tieback receptacle ("TBR"). Because the liner does not run to the surface, the liner hanger has the ability to receive the PBR or TBR to connect the liner with a string of casing that extends from the liner hanger back to the surface. There is typically a seal or seal stack between the PBR and the body of the packer that allows axial motion of the PBR relative to the liner top packer body. A standard seal stack includes a plurality of annular spaced seals that fit within the interior of the PBR. Often, a PBR is coupled into an upper end of the packer, and production tubing is stung into the PBR with an appropriate seal to prevent leakage between the interior of the PBR and the production tubing.

In operation, the work string lowers the liner into the portion of the wellbore that extends below the lower end of the previously set casing or liner. The liner hanger typically is lowered into the wellbore until the liner hanger is adjacent the lower end of the previously set casing or liner, and the lower end of the liner is above the bottom of the open borehole. Those of ordinary skill in the art will appreciate that it is desirable to have the inside diameter of the liner be as large as possible to allow more space for additional liners to be disposed within the well and to facilitate production.

When the liner reaches the desired location relative to the bottom of the open borehole and the previously set casing or liner, an anchor mechanism is actuated to move slips on the anchor mechanism from an original position to a displaced position, and into engagement with the previously set casing or liner. Once engaged with the surrounding surface, the anchor mechanism supports the weight of the liner hanger, a liner top packer, or both.

Typically, liner hangers and liner top packers use an anchor mechanism that may be actuated either hydraulically or mechanically. For example, a liner top packer often uses an anchor mechanism commonly referred to as a slip and cone assembly. In this manner, cone-shaped members are usually configured above and below the slips in such a way that the cones are moved toward each other to expand the slips outwardly into frictional engagement with the surrounding casing.

However, these slips sometimes displace outward prematurely before the anchoring mechanism is in place, thus the liner hanger assembly may anchor in the wrong location in the wellbore. Other times, as the liner hanger assembly is run into the wellbore, the slips may catch against downhole surfaces, which can cause damage to the anchor mechanism. In addition, when the anchor mechanism is set, the slips may break apart from a slip ring as the cones displace the slips outwardly. The slip assembly will then require removal from the wellbore for repair or replacement.

Accordingly, there exists a need for an improved slip assembly that may avoid pre-setting while running.

SUMMARY OF THE DISCLOSURE

In one aspect, embodiments disclosed herein relate to a liner hanger including a mandrel and a slip assembly disposed around the mandrel, wherein the slip assembly includes an expandable non-frangible slip ring and a plurality of gripping members.

In another aspect, embodiments disclosed herein relate to a liner top packer including a mandrel, a slip assembly disposed around the mandrel, the slip assembly including an expandable non-frangible slip ring and a plurality of gripping members disposed circumferentially around the expandable non-frangible slip ring, and a sealing element disposed around the mandrel.

In yet another aspect, embodiments disclosed herein relate to a method for setting a downhole tool in a wellbore, the method including running the downhole tool having a slip assembly disposed around a mandrel of the tool into the wellbore, the slip assembly including an expandable slip ring and a plurality of gripping members coupled to the slip ring, positioning the downhole tool at a predetermined wellbore location, actuating the tool to impart a force on the slip assembly, and expanding the expandable non-frangible slip ring from a first diameter to a second diameter to displace the gripping members radially outward into engagement with a surrounding surface.

Other aspects and advantages will be apparent from the following description and the appended claims.

BRIEF DESCRIPTION OF DRAWINGS

A full understanding of embodiments disclosed herein is obtained from the detailed description of the disclosure presented hereinbelow, and the accompanying drawings, which are given by way of illustration only and are not intended to be limitative of the present embodiments, and wherein.

DETAILED DESCRIPTION

Embodiments disclosed herein are described below with terms designating orientation in reference to a vertical wellbore. These terms designating orientation should not be deemed to limit the scope of the disclosure. For example, embodiments of the disclosure may be with reference to a non-vertical wellbore, such as a horizontal or lateral wellbore. It is to be further understood that the various embodiments described herein may be used in various orientations, such as inclined, inverted, horizontal, vertical, etc., and in other environments, such as sub-sea wells, without departing from the scope of the present disclosure.

In addition, other directional terms, such as "above," "below," "upper," "lower," etc., are used for convenience in referring to the accompanying drawings. In general, "above," "upper," "upward," and similar terms refer to a direction toward the earth's surface from below the surface along a wellbore, and "below," "lower," "downward," and similar terms refer to a direction into the Earth from the surface (i.e., into the wellbore), but is meant for illustrative purposes only, and the terms are not meant to limit the disclosure.

Figure 1:
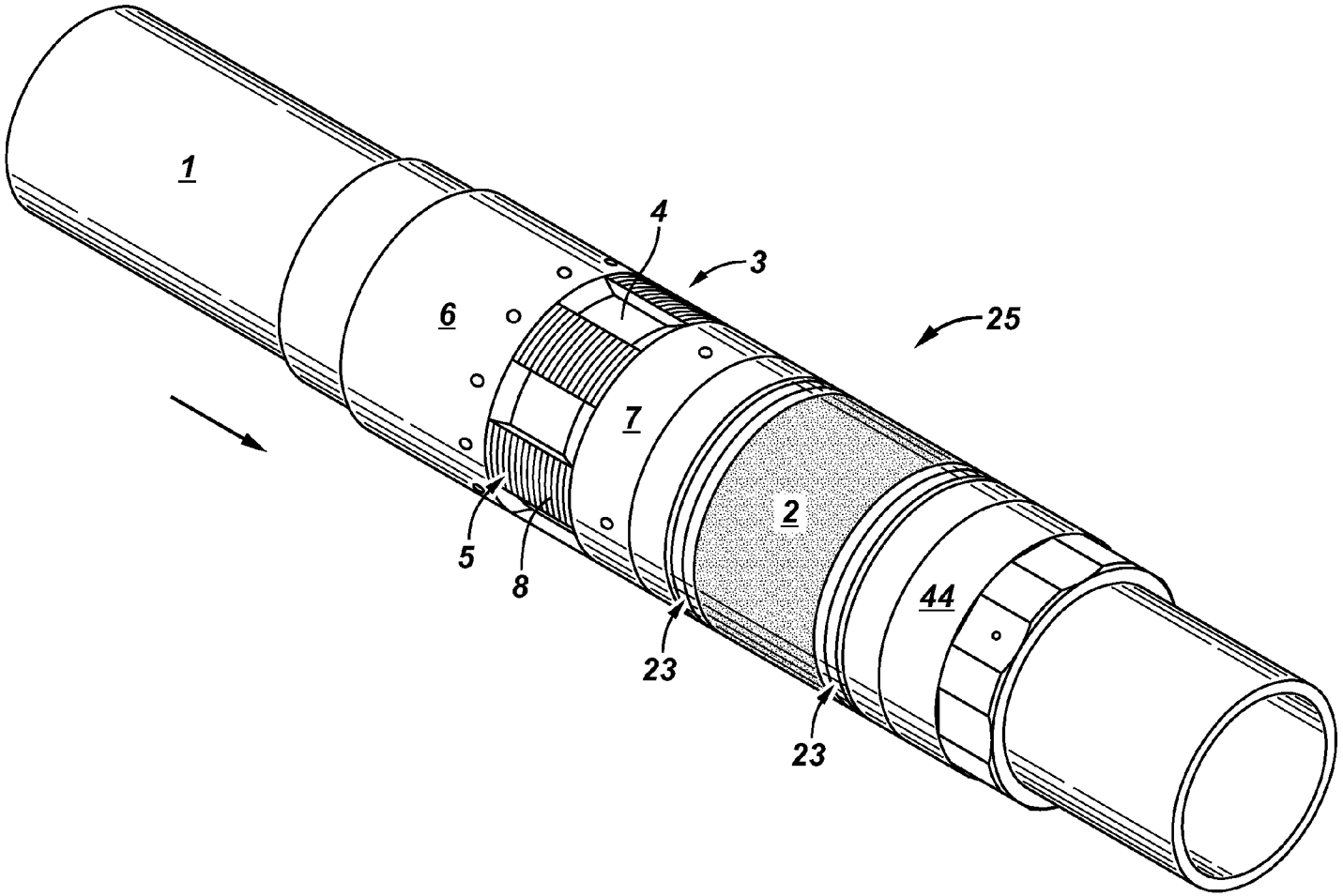
FIG. 1 shows an isometric view of a liner top packer, in accordance with embodiments of the present disclosure.

Referring to FIG. 1, an isometric view of a liner top packer according to embodiments of the present disclosure is shown. A liner top packer 25 may include a slip assembly 3 configured to engage a surrounding liner or tubular (not shown) upon actuation and a sealing element 2 to seal between the liner top packer 25 and the surrounding liner or tubular (not shown). Thus, the slip assembly 3 may be used to provide resistance against hydraulic forces or other inadvertent forces that may otherwise tend to move the liner top packer 25. Forces applied to supported devices may be axially translated through the slip assembly 3. Though illustrated and described with respect to the liner top packer 25, the slip assembly 3 is not limited to only liner top packers, and as such, may be used with various downhole devices and tubulars, such as, for example, a liner hanger, as discussed in more detail below.

As shown, the liner top packer 25 includes a mandrel 1 with slip assembly 3 disposed therearound. The slip assembly 3 may include an expandable non-frangible slip ring 4, and a plurality of gripping members 5 disposed along the expandable non-frangible slip ring 4. The slip assembly 3 is configured to radially expand and engage the surrounding surface to anchor or support the liner top packer 25 within the surrounding tubular or wellbore (15, FIG. 6). The sealing element 2 may be configured in the shape of an annular band, which when compressed axially, may radially expand to provide a seal between the outer surface of the liner top packer 25 and a surrounding surface wall within the wellbore (15, FIG. 6).

The sealing element 2 may be a conventional sealing element that is well known in the use of liner top packers and downhole sealing devices. The sealing element 2 may be disposed around the mandrel 1, and below the slip assembly 3. At least one anti-extrusion ring 23 may be disposed adjacent the sealing element 2 to prevent extrusion of the sealing element 2 when the liner top packer 25 is set. In certain embodiments, there may be multiple anti-extrusion rings 23 disposed around mandrel 1. In addition, there may be at least one gage ring 44, which may provide a larger diameter surface to prevent snagging or catching of the slip assembly 3 on downhole surfaces as the liner top packer 25 is lowered into the wellbore. The gage ring 44 may be disposed above or below the at least one anti-extrusion ring 23.

Figure 2:
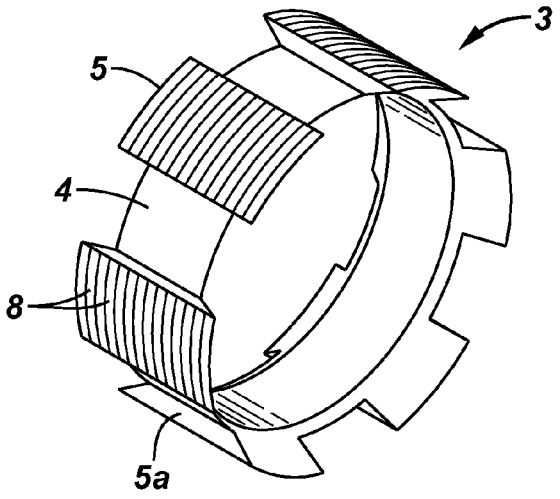
FIG. 2 shows an isometric view of a slip assembly, in accordance with embodiments of the present disclosure.

Referring to FIG. 2, an isometric view of a slip assembly 3 according to embodiments of the present disclosure is shown. The expandable non-frangible slip ring 4 may be circularly-shaped and the plurality of gripping members 5 may be disposed at select locations along the circumference of the slip ring 4. For example, the plurality of gripping members 5 may be disposed circumferentially around the expandable slip ring 4 at about 20 to 60 degree intervals. In one embodiment, the gripping members 5 may be integrally formed with the slip ring 4. In alternate embodiments, the gripping members 5 may be coupled to the slip ring 4 by any means known in the art, such as, for example, welding or bonding. In an exemplary embodiment, the gripping members may be non-frangibly coupled to the slip ring 4 so that the gripping members 5 remain coupled to the slip ring 4 when the slip ring 4 is expanded radially outward. One of ordinary skill will appreciate that the gripping members 5 may be disposed at other locations or intervals depending on, for example, the number of gripping members, the width of each member, the number of teeth, the diameter of the slip ring, etc.

The shape and configurations of the gripping members 5 may vary based on the application and use of the particular gripping members 5. For example, the plurality of gripping members 5 may be configured with a cross-sectional wedge-shape portion 5*a*. In one embodiment, the wedge-shape portion 5*a* allows a corresponding cone-shaped surface (not shown) to engage the slip assembly 3 and displace the gripping members 5 radially outward when set. The plurality of gripping members 5 may also be configured with an outer surface having teeth 8. In one embodiment, the outer surface of the gripping members 5 may have teeth 8 that are bi-directional. In this aspect, the gripping members 5 have teeth that face in both an upwardly and downwardly direction. Accordingly, a downhole device (not shown) may be supported in place because the bi-directional teeth 8 will engage the surrounding surface (not shown) regardless of any directional force or movement that the device may incur. In one embodiment, the plurality of gripping members 5 may be slips, and in an exemplary embodiment, the slips may be wickered slips. The plurality of gripping members 5 may be made from material of construction as would be known by a person having ordinary skill in the art. For example, the plurality of gripping members 5 may be made from steel or tungsten carbide. In certain embodiments, the teeth of the gripping members 5 may be heat treated.

Figure 3A:
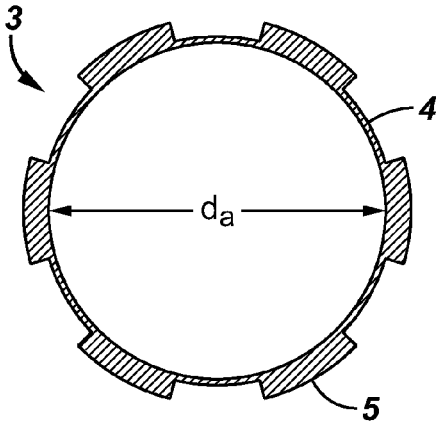
FIGS. 3A and 3B show a cross-sectional view of an unexpanded and expanded slip assembly, respectively, in accordance with embodiments of the present disclosure.
Figure 3B:
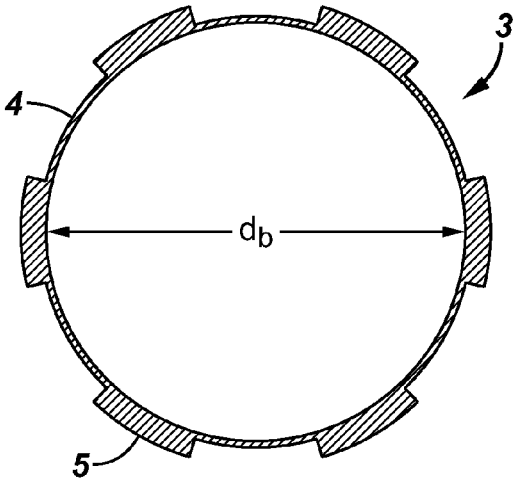

Referring to FIGS. 3A and 3B, a cross-sectional view of an unexpanded and expanded slip assembly 3, respectively, according to embodiments of the present disclosure is shown. FIG. 3A illustrates the expandable non-frangible slip ring 4 configured in a first unexpanded diameter $d_a$ before actuation of the liner top packer 25 (FIG. 1). In one embodiment, the slip ring 4 may be made from materials of construction allow the slip ring 4 to expand without fracture during setting of the liner top packer 25 (FIG. 1). For example, the expandable slip ring 4 may be made from ductile steel. In a further example, the expandable slip ring 4 may be made from 80,000 psi yield strength steel. In certain embodiments, the expandable slip ring 4 may have greater than 20 percent elongation from the first unexpanded diameter $d_a$. FIG. 3B illustrates the expandable slip ring 4 configured in an expanded state to a second diameter $d_b$ after the liner top packer 25 (FIG. 1) is set.

Figure 4:
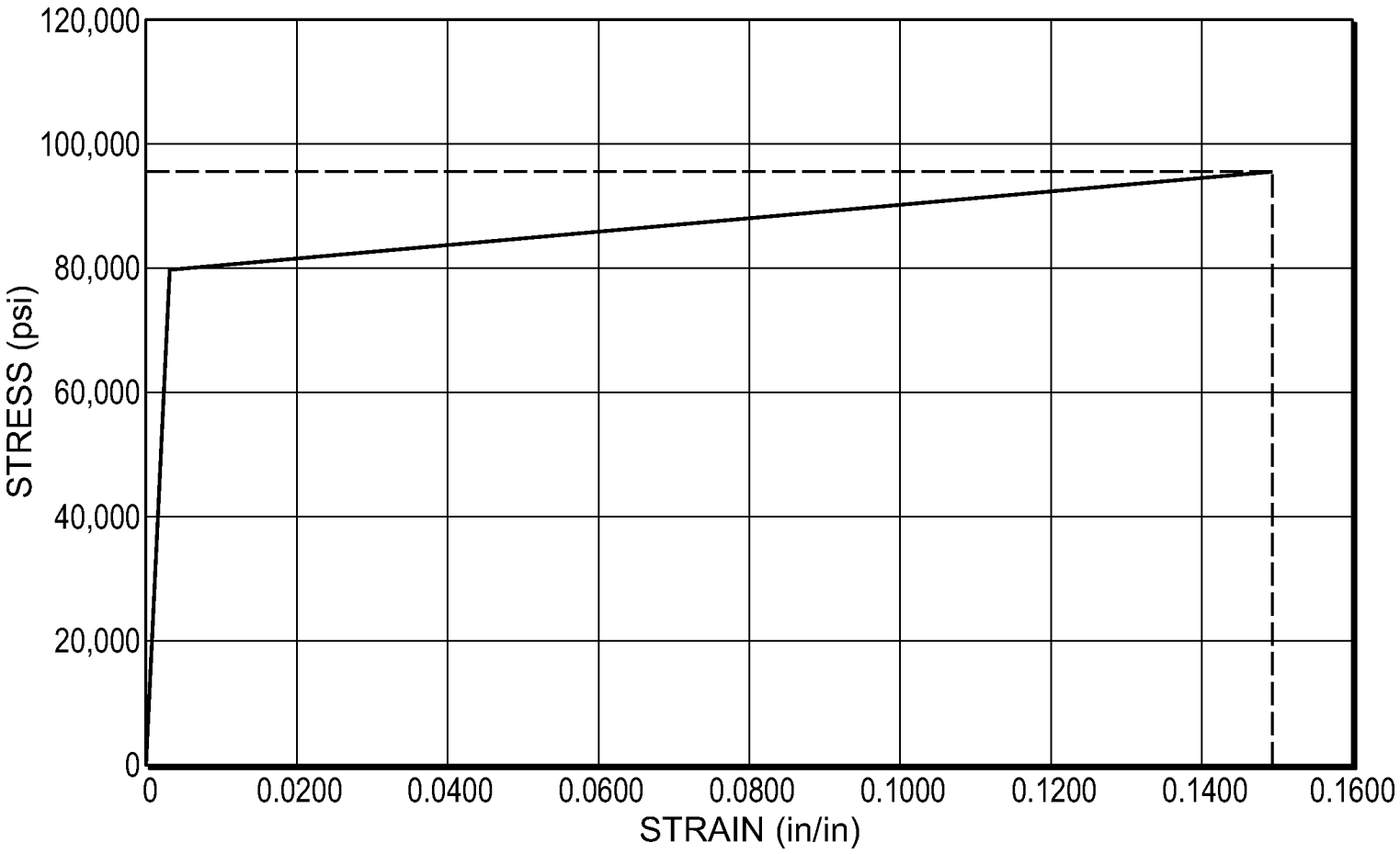
FIG. 4 shows a stress/strain graphical illustration of an example expandable slip ring, in accordance with embodiments of the present disclosure.

Referring to FIG. 4, a stress-strain curve of an example expandable slip ring according to embodiments of the present disclosure is shown. The stress-strain curve is a graphical representation of the relationship between stress, derived from measuring a load applied on the example expandable slip ring, and strain, derived from measuring the deformation of the example expandable slip ring (i.e., elongation, compression, or distortion, etc.). The nature of the stress-strain curve varies depending upon the material from which the expandable slip ring is formed. Table 1 below shows the material properties of the example expandable slip ring yielding the stress-strain curve graphically illustrated in FIG. 4.

TABLE 1

Example Expandable Material Properties and Post-Expansion Data

| | | | | | |
|---|---|---|---|---|---|
| Material Properties | | | | | |
| $\sigma_y$ = | 80,000 psi | $\sigma_u$ = | 96,000 Psi | | |
| $\nu_y$ = | 0.30 | $\nu_u$ = | 0.50 | | |
| E = | 30,000,000 psi | $\epsilon_u$ = | 0.1500 in/in | | 15.00% |
| Pre-Expansion Geometry | | | | | |
| $ID_{pe}$ = | 7.210 in | $ID_{csg}$ = | 8.968 in | | |
| $OD_{pe}$ = | 7.460 in | $\alpha_c$ = | 25 deg | | |
| $OAL_{pe}$ = | 1.640 in | | | | |
| $t_{pe}$ = | 0.125 in | $r_{pe}$ = | 3.605 in | | |
| Post-Expansion Geometry | | | | | |
| $OD_c$ = | 8.290 in | $\epsilon_{exp}$ = | 0.1498 in/in | | 14.98% |
| Elastic Expansion | | | | | |
| $\epsilon_y$ = | 0.0027 in/in | | | | 0.27% |
| Plastic Expansion | | | | | |
| $E_p$ = | 108,597 psi | $b_p$ = | 79,710 psi | | |
| $\sigma_{exp}$ = | 95,977 psi | | | | |
| Expansion Pressure/Force | | | | | |
| $P_i$ = | 3,328 psi | $A_{exp}$ = | 37.147 $in^2$ | | |
| Fa = | 123,624 lb | $\mu$ = | 0.20 | | |
| F1 = | 62,384 lb | | | | |
| F2 = | 62,384 lb | | | | |
| Fs = | 26,365 Lb | | | | |

In this example, a slip ring having properties of an unexpanded inner diameter ($ID_U$) of 7.210 inches, a yield strength of 80,000 psi, an ultimate strength of 96,000 psi, and a shear modulus of 0.2 was selected. The expansion pressures and forces determined in Table 1 are based on a slip ring area of approximately 37.147 $in^2$.

After application of the expansion pressure, the post-expansion measurement of the slip ring resulted in an outer diameter ($OD_C$) of 8.290 inches. Accordingly, the example slip ring had a post-expansion elongation of about 15%, as calculated by Equation 1 below.

$$(100\%)*(OD_C-ID_{PE})/ID_{PE}=\text{Post Expansion elongation (percent)} \quad [1]$$

Figure 5:
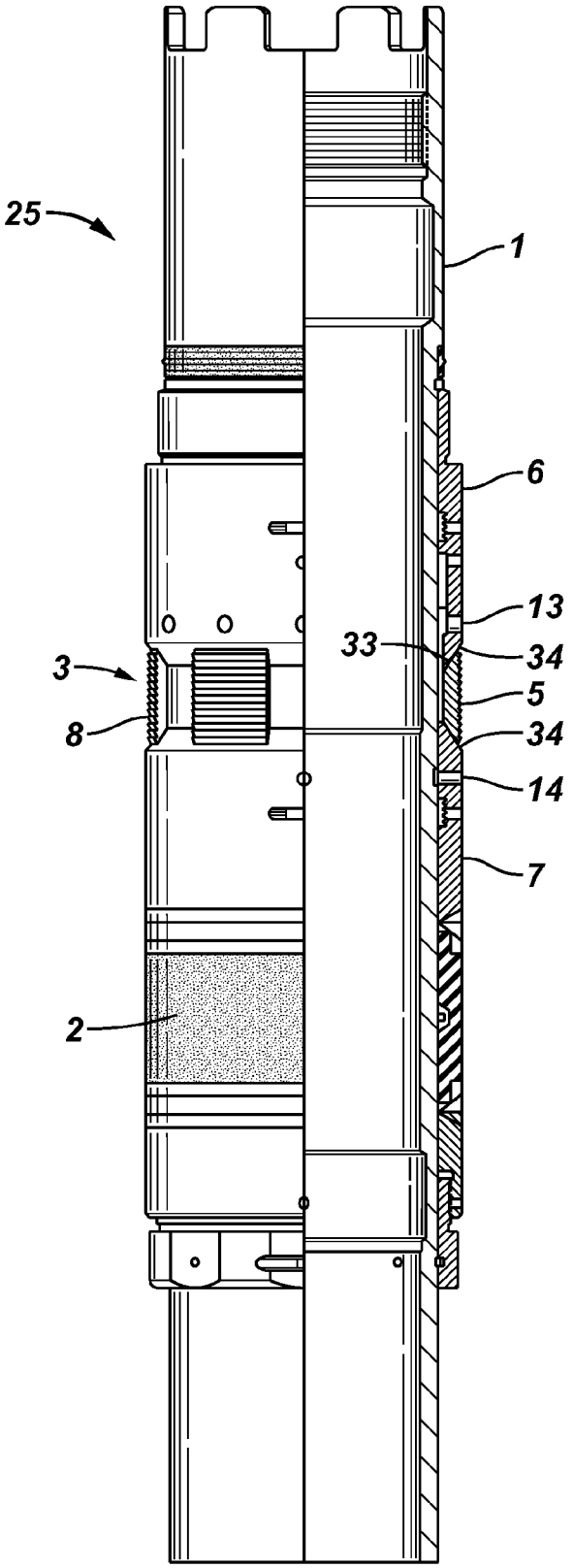
FIG. 5 shows a cut-away sectional view of a liner top packer, in accordance with embodiments of the present disclosure.

Referring to FIG. 5, a cut-away sectional view of a liner top packer 25 according to embodiments of the present disclosure is shown. As illustrated, the liner top packer 25 includes the slip assembly 3, an upper cone member 6, and a lower cone member 7. The slip assembly 3 is configured to anchor or support the liner top packer 25 within the wellbore. The slip assembly 3 may be disposed between the cone members 6 and 7, respectively, so that the plurality of gripping members 5 may have an inner cam surface 33 configured to contact a corresponding surface 34 of each of the cone members 6 and 7. In one embodiment, the surfaces 33 and 34 may be inclined toward each other, respectively, in the range of 5 to 30 degrees. In another embodiment, the degree of inclination of the surfaces may be in the range of 15 to 25 degrees. One of ordinary skill in the art will appreciate that this angle may vary and is not intended to limit the scope of embodiments disclosed herein.

Once the liner top packer 25 is actuated, the cone members 6 and 7 may be axially moved toward the gripping members 5, such that corresponding angles of the surfaces 33 and 34, and the contact therebetween, displaces the gripping members 5 radially outward. To prevent premature actuation, one or more retaining means may be provided to secure the cones 6 and 7 in place along the mandrel 1. In one embodiment, the retaining means may include an upper shearing device 13 and a lower shearing device 14. The shearing devices 13 and 14 may be a plurality of shear screws disposed above and below the slip assembly 3, respectively. As illustrated, the upper and lower shearing devices 13 and 14 may be disposed laterally through the upper and lower cone members 6 and 7, respectively. The shearing devices 13 and 14 may be configured to be sheared at a pre-determined amount of shearing force, as would be known by a person having ordinary skill in the art. Thus, the cones 6 and 7 may be actuated to move axially at a pre-determined axial load. For example, the shearing force may be in the range of 5 to 50 klbs. In one embodiment, the upper shearing device 13 may be configured to shear upon a shearing force in excess of 40 klbs. In another embodiment, the lower shearing device 14 may be configured to shear upon a shearing force in excess of 12 klbs.

The liner top packer 25 may be set by either a mechanical or a hydraulic device. For example, a hydraulic device may be used to hydraulically actuate the liner top packer 25. The hydraulic device (not shown) may include an actuator piston or ram (not shown) slidably engaged with the mandrel 1. In one embodiment, the upper shearing device 13 may be disposed laterally through the upper cone member 6, and engage only the surface of the mandrel 1. In this configuration, axial movement of the mandrel 1 below a certain set point will not shear the upper shearing device 13. In another embodiment, the lower shearing device 14 may be disposed axially through the lower cone member 7, as well as the mandrel 1. In this configuration, axial longitudinal movement of the mandrel 1 with a sufficient amount of force will shear the lower shearing device 14. Thus, as an example, a hydraulic cylinder chamber may be pressurized to apply force to the actuator piston (not shown). Once the force exceeds a pre-determined set point, the piston may axially move the mandrel 1 in order to shear the lower shearing device 14, thus actuating the liner top packer 25. Once actuated, the cone members 6 and 7, and the sealing element 2 are compressed so that the plurality of gripping members 5 and the sealing element 2 displace outwardly into engagement with the surrounding surface (not shown). During the compression, a lock ring and ratchet system (not shown) may be used to hold the cone members 6 and 7 in place and to prevent them from moving away from each other.

Although the upper shearing device 13 is described as not extending into the mandrel 1, the description is not meant to be limiting. Thus, although not illustrated, the upper shearing device 13 may be disposed laterally through the upper cone member 7, as well as through the mandrel 1. In one embodiment, the upper shearing device 13 is disposed laterally through the upper cone member 7 and the through the mandrel 1, while the lower shearing device 14 is disposed laterally through the lower cone member 7, and engages only the surface of the mandrel 1. In another embodiment, shearing devices 13 and 14 may both be laterally disposed through the cone members 6 and 7, respectively, and both laterally disposed through the mandrel 1.

Figure 6:
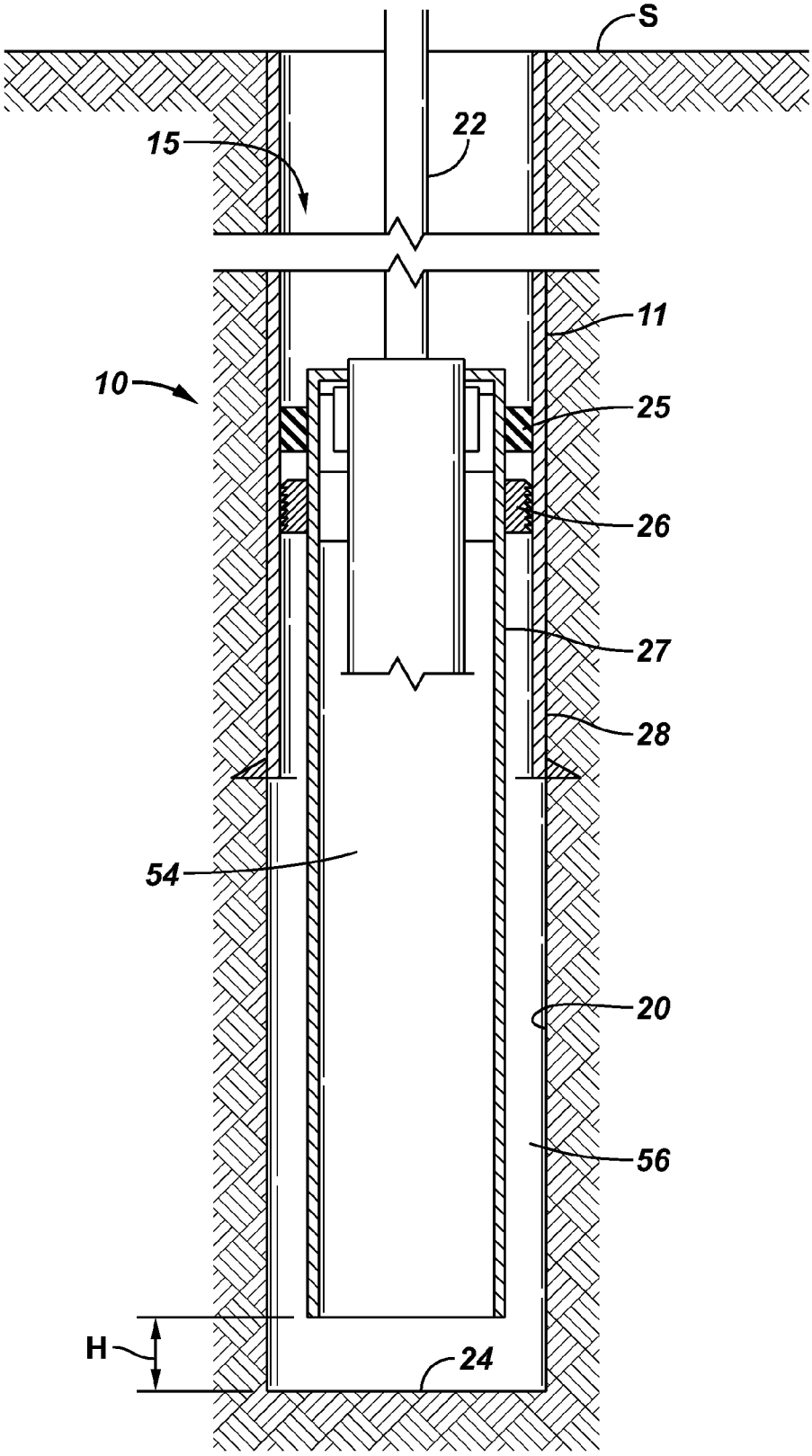
FIG. 6 shows a cross-sectional elevation view of a liner hanger assembly, in accordance with embodiments of the present disclosure.

Referring to FIG. 6, a cross-sectional elevation view of a liner hanger assembly according to embodiments of the present disclosure is shown. As illustrated, the liner hanger assembly 10 may include various components coupled together that are deployed in a wellbore 15. For example, the liner hanger assembly 10 may include a liner top packer 25 suspended by a work string 22. The wellbore 15 may include a host casing 11 that may extend downwardly from the surface S, or a previously set string of casing or liner. In one embodiment, the liner top packer 25 may be suspended within the lower end 28 of host casing 11, such that an overlap between a liner 27 and the host casing 11 may be formed. The liner top packer 25 may include a slip assembly 3 (FIG. 5), as previously described, configured to anchor or support the liner top packer 25 within the wellbore 15.

In addition to the depth of the wellbore that has host casing 11, the wellbore 15 may be drilled to a deeper depth shown by an uncased portion of the wellbore 20. The liner 27 may be lowered into the uncased portion 20 through the host casing 11 and coupled to the lower end 28 of the host casing 11. The lower end of liner 27 may be suspended a height H from the bottom 24 of the wellbore 15. As illustrated, there may be a vertical flowbore 54 within the wellbore 15 extending toward the surface S. Similarly, liner 27 and host casing 11 may form another annulus 56 that may extend upwardly from the bottom 24 toward the surface S.

As mentioned, in addition to the liner top packer 25, the liner hanger assembly 10 may include other components, such as a liner hanger 26. Accordingly, the liner hanger 26 may be supported by a slip assembly (not shown) that functions as described above. In one embodiment, the liner hanger 26 is anchored against the host casing 11 by a first slip assembly (not shown), and the liner top packer 25 is anchored against the host casing 11 by a second slip assembly (not shown). In certain embodiments, the liner top packer 25 may be disposed above the liner hanger 26. Although shown together, the liner hanger assembly 10 does not require both the liner hanger 26 and the liner top packer 25 in order for the assembly 10 to be operable. For example, the liner hanger assembly 10 need not include the liner top packer 25.

As illustrated, the liner hanger 26 may also be suspended within the lower end 28 of host casing 11, such that an overlap between the liner 27 and the host casing 11 may be formed. The liner hanger 26 includes a mandrel (not independently illustrated) having an upper end configured to couple to a polished bore receptacle (not shown), which may provide a tieback means for the liner hanger 26. Generally, the mandrel may be operatively connected between multiple components of the liner hanger assembly 10. In one embodiment, the PBR may be disposed above the liner top packer (not shown). In another embodiment, the PBR may be rigidly connected to the liner 27. For example, the rigid connection may be provided by a metal-to-metal threaded connection; however, the PBR may be coupled with the liner 27 by any coupling means known to a person of ordinary skill in the art.

The tieback means may be sealingly engaged with the top of the liner hanger 26. In one embodiment, the tieback means may include a seal stack, which may be disposed within the PBR (not shown). The seal stack, though not shown, may be any stack of seals as would be known by a person having ordinary skill in the art. For example, the seal stack may include a plurality of seals designed for insertion into the PBR (not shown). In one embodiment, the seals may be annular seals or chevron seals. The PBR may be used in combination with the seal stack in order to accommodate expansion and contraction of components in the liner hanger assembly without disturbing the operation of the assembly.

Figure 7:
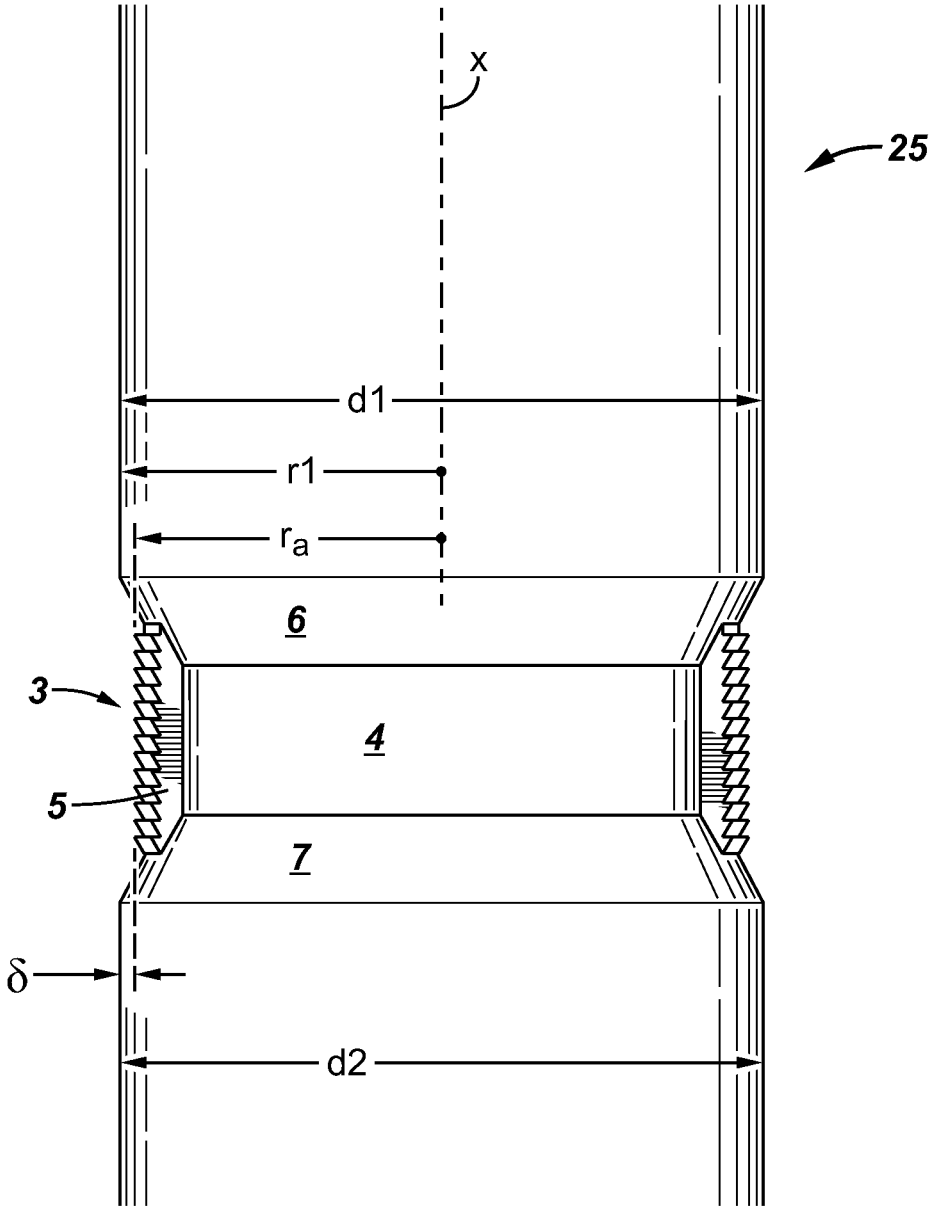
FIG. 7 shows a close-up side view of a slip assembly recessed within an anchor mechanism, in accordance with embodiments of the present disclosure.

Referring now to FIG. 7, a close-up side view of a slip assembly 3 disposed about a mandrel (not shown) of a downhole tool in accordance with embodiments of the present disclosure is shown. FIGS. 3A, 3B and 7 together show an upper cone member 6 having an outer diameter d1, the upper cone member disposed above the slip assembly 3, and a lower cone member 7 having an outer diameter d2, the lower cone member 7 disposed below the slip assembly 3. As illustrated by FIG. 3A, the slip assembly 3 may have a first outer diameter $d_a$ in an unexpanded state, such that the first outer diameter $d_a$ is less than the outer diameters d1 and d2 of both the cone members 6 and 7, respectively. As illustrated in FIG. 3B, the slip assembly 3 may have a second outer diameter $d_b$ in an expanded state, such that the second outer diameter $d_b$ is greater than the outer diameters d1 and d2 of both the cone members 6 and 7, respectively.

Upon actuation of the downhole tool, the upper cone member 6 and lower cone member 7 may move axially toward each other, such that the cone members 6 and 7 impart an axial force on the slip assembly 3 that causes the expandable non-frangible slip ring 4 to expand and displace the plurality of gripping members 5 radially outward and into engagement with a surrounding wall, e.g., host casing 11. In an alternate embodiment, the upper cone member 6 may move axially toward a static lower cone member 7 that is held fixedly in place.

In operation, the slip assembly 3 may be recessed inwardly with respect to an outer diameter of a component of the downhole tool as the downhole tool, e.g., liner hanger or liner top packer, is run downhole. For example, the slip assembly 3 may be recessed with respect to the cone members 6 and 7. As illustrated in FIG. 7, the slip assembly 3 may have a radial difference δ between a first outer radial distance $r_a$ of the gripping members in the unexpanded state and an outer radial distance of both cone members r1. These radii may be determined by the length of the lateral radial distance from a central longitudinal axis x. In one embodiment, the radial difference δ between a first outer radial distance of the gripping members in the unexpanded state and an outer radial distance of both cone members is in the range of 0.001 to 0.2 inches. In an exemplary embodiment, the radial difference 8 between a first outer radial distance of the gripping members in the unexpanded state and an outer radial distance of both cone members is in the range of 0.005 to 0.1 inches.

Embodiments of the present disclosure include a method for setting a downhole tool in a wellbore. The method may include various steps, such as running the downhole tool having a slip assembly into the wellbore. The slip assembly may be used to support the downhole tool, e.g., a liner top packer or a liner hanger, within a host tubular. Upon actuation, the slip assembly may be anchored against a surrounding surface, such as a casing or a liner. Thus, the slip assembly may also be used to provide resistance against hydraulic forces or other inadvertent forces that may tend to move or displace the downhole tool.

The downhole tool may include a mandrel and a slip assembly disposed around the mandrel. The downhole tool may also include an upper cone member having an upper shearing device, and a lower cone member having a lower shearing device. The slip assembly may include an expandable non-frangible slip ring and a plurality of gripping members connected to the slip ring. The expandable non-frangible slip ring may be made from materials of construction provide expansion of the slip ring without fracture. For example, the expandable slip ring may be made from ductile steel. In a further example, the expandable slip ring may be made from 80,000 psi yield strength steel. In an exemplary embodiment, the expandable slip ring may have greater than 20 percent elongation from a first unexpanded diameter. The slip assembly may be configured to radially expand and engage the surrounding surface so that the slip assembly may accordingly anchor or support the downhole device within the wellbore.

The gripping members may include various shapes and configurations, such as a configuration having a cross-sectional wedge-shape. The plurality of gripping members may also be configured with an outer surface having teeth. In one embodiment, the outer surface of the gripping members may have teeth that are bi-directional.

The gripping members may be integrally formed with the expandable non-frangible slip ring. In one embodiment, the gripping members may be coupled to the slip ring by any means known in the art, such as, for example, by welding or bonding. In an exemplary embodiment, the gripping members may be non-frangibly coupled to the slip ring so that the gripping members remain coupled to the slip ring after they are displaced radially outward.

Other steps of the method may include positioning the downhole device at a pre-determined wellbore location and actuating the anchor mechanism. In one embodiment, actuating the anchor mechanism may include shearing the upper shearing device and the lower shearing device. The upper and lower shearing devices may be disposed laterally through the upper and lower cone members, respectively. Further steps may include actuating the downhole tool so that the upper cone member and the lower cone member impart a radial force on the slip assembly, and expanding the expandable slip ring from a first diameter to a second diameter to displace the gripping members radially outward into engagement with a surrounding surface.

Advantageously, the present disclosure may provide an improved slip assembly that may avoid pre-setting while running. Beneficially, the slip assembly may be configured to require a smaller amount of force in order to set the gripping members. Furthermore, the force required to set the tool, and therefore, the gripping members, may be more predictable than conventional setting tools.

Other advantages of the present disclosure may provide a slip ring and gripping members that do not break apart from each other upon setting. Significantly, the slip ring may be made from an expandable material, such that the gripping members may be displaced radially outwardly while remaining in a non-frangible connection with the expandable slip ring. When the tool is run downhole, the gripping members may be held securely in place, thereby reducing the risk of damage to the gripping members and pre-setting of the tool.

Further advantages of the present disclosure may include an anchor mechanism used in supporting or anchoring other downhole tools, which may involve applications not related to a liner hanger.

While the present disclosure has been described with respect to a limited number of embodiments, those skilled in the art, having benefit of the present disclosure will appreciate that other embodiments may be devised which do not depart from the scope of the disclosure described herein. Accordingly, the scope of the disclosure should be limited only by the claims appended hereto.

What is claimed is:

1. A liner hanger comprising:

a liner top packer, comprising:

a mandrel; and a slip assembly disposed around the mandrel, wherein the slip assembly comprises:

an expandable non-frangible slip ring; and a plurality of gripping members permanently affixed to the expandable non-frangible slip ring along an exterior of the expandable non-frangible slip ring, the expandable non-frangible slip ring being a continuous ring of ductile material which is plastically deformable without fracture as the expandable non-frangible slip ring is expanded from an unexpanded diameter to a larger expanded diameter; and a liner, the liner being coupled to a host casing by the liner top packer.

2. The liner hanger of claim 1, further comprising:

an upper cone member having an outer diameter, the upper cone member being disposed above the slip assembly; and a lower cone member having an outer diameter, the lower cone member being disposed below the slip assembly, wherein the slip assembly further comprises the unexpanded diameter in an unexpanded state that is less than the outer diameters of both the upper cone member and the lower cone member, and the larger expanded diameter in an expanded state that is greater than the outer diameters of the upper cone member and the lower cone member.

3. The liner hanger of claim 2, wherein the upper cone member and lower cone member move axially toward each other when the liner hanger assembly is set, such that the cone members impart a force on the slip assembly that displaces the plurality of gripping members radially outward.

4. The liner hanger of claim 3, wherein a radial difference between a first outer radial distance of the plurality of gripping members in the unexpanded state and an outer radial distance of both cone members is in the range of 0.005 to 0.1 inches.

5. The liner hanger of claim 1, wherein the expandable non-frangible slip ring is formed from ductile steel.

6. The liner hanger of claim 1, wherein the expandable non-frangible slip ring is formed from a material having approximately 15 percent elongation.

7. A liner top packer comprising:

a mandrel;

a slip assembly disposed around the mandrel, the slip assembly comprising:

an expandable non-frangible slip ring forming a continuous ring of ductile material; and a plurality of gripping members permanently affixed to the expandable non-frangible slip ring and disposed circumferentially around the expandable non-frangible slip ring, each gripping member being mounted entirely externally of the expandable non-frangible slip ring such that the plurality of gripping members extends radially outwardly from the expandable non-frangible slip ring; and a sealing element disposed around the mandrel.

8. The liner top packer of claim 7, wherein the plurality of gripping members comprise a cross-sectional wedge shape.

9. The liner top packer of claim 7, wherein the plurality of gripping members are slips.

10. The lighter top packer of claim 9, wherein the slips are wickered slips.

11. The liner top packer of claim 7, wherein the plurality of gripping members comprise bidirectional gripping elements.

12. The liner top packer of claim 7, wherein the expandable non-frangible slip ring is made from ductile steel.

13. The liner top packer of claim 7, wherein the expandable non-frangible slip ring has greater than 20 percent elongation from a first unexpanded diameter.

14. The liner top packer of claim 7, wherein the plurality of gripping members are made from tungsten carbide.

15. The liner top packer of claim 7, wherein each of the plurality of gripping members are disposed at intervals around the expandable slip ring in the range of 20 to 60 degrees apart from each other.

16. The liner top packer claim 7, wherein the slip assembly has an outer diameter in an unexpanded state that is less than an outer diameter of at least one other component of the liner top packer, and wherein the outer diameter of the slip assembly in an expanded state is greater than the outer diameter two or more components of the liner top packer.

17. A method for setting a downhole tool in a wellbore, the method comprising:

running a liner top packer downhole into the wellbore with a liner, the liner top packer having a slip assembly disposed around a mandrel, the slip assembly comprising:

an expandable slip ring; and a plurality of gripping members integrally formed with the slip ring such that the slip ring is positioned along a radially interior side of the plurality of gripping members;

positioning the liner top packer at a pre-determined wellbore location within a host casing;

actuating the tool to impart a force on the slip assembly; and expanding the expandable non-frangible slip ring plastically without fracture from a first diameter to a second diameter to displace the gripping members radially outward into engagement with a surrounding surface of the host casing to suspend the liner from the host casing.

18. The method of claim 17, wherein a hydraulic or a mechanical device actuates the expandable non-frangible slip ring.

* * * * *